United States Patent [19]

Crapser et al.

[11] Patent Number: 4,767,059

[45] Date of Patent: Aug. 30, 1988

[54] PISTON-POWERED DISPENSING SYSTEM

[75] Inventors: James R. Crapser; Mark E. Wefler, both of Racine County, Wis.

[73] Assignee: S. C. Johnson & Son, Inc., Racine, Wis.

[21] Appl. No.: 153,737

[22] Filed: Feb. 8, 1988

[51] Int. Cl.[4] ..... B05B 7/24

[52] U.S. Cl. ..... 239/314; 137/99; 222/134; 222/144.5; 239/315; 239/322; 239/414; 239/416

[58] Field of Search ..... 239/310, 313, 314, 315, 239/322, 331, 414, 416, 416.4, 424.5; 137/99; 222/134, 144.5

[56] References Cited

U.S. PATENT DOCUMENTS

| | | | |
|---|---|---|---|
| 368,259 | 8/1887 | Warren . | |
| 716,910 | 12/1902 | Lubbecke . | |
| 1,030,119 | 6/1912 | Overbeke | 239/322 |
| 1,117,228 | 11/1914 | Overbeke . | |
| 1,179,905 | 4/1916 | Englemann . | |
| 1,241,551 | 10/1917 | Preston et al. . | |
| 1,347,520 | 7/1920 | Rasch . | |
| 1,370,687 | 3/1921 | Ferris . | |
| 1,382,684 | 6/1921 | Shimper | 239/424.5 |
| 1,578,944 | 3/1926 | Wilkinson | 239/322 |
| 1,579,869 | 4/1926 | Klages | 239/315 |
| 1,590,430 | 6/1926 | Erby | 239/322 |
| 1,948,533 | 2/1934 | Neely . | |
| 2,096,554 | 10/1937 | Maehr . | |
| 2,228,705 | 1/1941 | Olson . | |
| 2,620,234 | 12/1952 | Schaich | 239/322 |
| 2,708,600 | 5/1955 | Froidevaux | 239/322 |
| 2,891,732 | 6/1959 | Orter et al. | 239/322 |
| 3,182,860 | 5/1965 | Gallo . | |
| 3,192,950 | 7/1965 | Weese et al. . | |
| 3,217,936 | 11/1965 | Abplanalp . | |
| 3,225,759 | 12/1965 | Drapen et al. . | |
| 3,261,426 | 7/1966 | Kuhlman . | |
| 3,391,829 | 7/1968 | Gregory | 239/313 |
| 4,047,541 | 9/1977 | Mercier et al. | 239/322 |
| 4,134,523 | 1/1979 | Hansen et al. . | |
| 4,174,068 | 11/1979 | Rudolph | 239/322 |
| 4,406,406 | 9/1983 | Knapp | 239/322 |
| 4,418,869 | 12/1983 | Healy . | |
| 4,545,535 | 10/1985 | Knapp . | |
| 4,583,688 | 4/1986 | Crapser | 239/314 |
| 4,653,691 | 3/1987 | Grime | 239/416 |
| 4,682,734 | 7/1987 | Proctor et al. | 239/315 |

*Primary Examiner*—Andres Kashnikow
*Assistant Examiner*—Michael J. Forman

[57] ABSTRACT

A fluid-dispensing system is disclosed. The dispensing system comprises an apertured base, a hollow cylinder, an apertured piston, an orificed overcap, a fluid passageway, an apertured extension, and three valves. The piston, slidably engageable within the cylinder, divides the cylinder into two chambers. The cylinder defines a hollow neck at one end portion thereof. The overcap defines an apertured throat that is slidably engageable within the cylinder neck. The throat aperture of the overcap provides fluid communication between one cylinder chamber and a fluid-mixing region spaced from the fluid-dispensing system. The fluid passageway, disposed through the piston aperture, provides fluid communication between a pressurized-fluid source and the fluid-mixing region via at least one orifice of the overcap. The base defines an apertured sleeve. The hollow extension, slidably engageable within the sleeve, is in fluid communication with the one overcap orifice via the fluid passageway. At least one aperture of the extension, when disposed in the sleeve, is alignable with an aperture of the sleeve. The first valve, carried by the base, is utilized to controllably affect flow of a pressurized fluid from the pressurized-fluid source to the fluid passageway. The second valve, provided by relative movement between the extension and the sleeve, is utilized to controllably affect flow of the pressurized fluid between the fluid passageway and the other of the two cylinder chambers. The third valve, provided by relative movement between the cylinder neck and the overcap throat, is utilized to controllably affect flow between the other cylinder chamber and the fluid-mixing region.

7 Claims, 4 Drawing Sheets

PISTON-POWERED DISPENSING SYSTEM

TECHNICAL FIELD OF THE INVENTION

The present invention is generally directed to a piston-powered fluid dispensing system. The piston-powered fluid dispensing system, more particularly, is specifically configured to externally mix internally-contained fluid ingredients that are to be dispensed.

BACKGROUND OF THE INVENTION

Compartmented spray devices, wherein certain spraying compartments are separated by a movable piston, are generally well known. (See, e.g., U.S. Pat. No. 1,030,119 to Overbeke.) Many sprayer devices of this kind often present certain problems in operation and, as a result, greater sophistication or complexity in design is often deemed warranted. Greater complexity in design, however, typically gives rise to greater complexity in operation. (See, in particular, U.S. Pat. No. 1,117,228, also to Overbeke; and see U.S. Pat. No. 1,241,551 to Preston et al.; U.S. Pat. No. 1,347,520 to Rasch; U.S. Pat. No. 3,217,936 to Abplanalp; U.S. Pat. No. 3,225,759 to Drapen et al.; and U.S. Pat. Nos. 4,406,406 and 4,545,535, both to Knapp.)

Fluid dispensing systems that are particularly designed to internally mix ingredients are similarly well known. (See, e.g., U.S. Pat. No. 368,259 to Warren; and U.S. Pat. Nos. 4,406,406 and 4,545,535, both to Knapp.) For a number of reasons, however, it is desirable to mix ingredients external to the dispensing system. In particular, reliance upon a dispensing system that internally mixes ingredients can, in certain situations, lead to undesired contamination of a pure ingredient source that is in fluid communication with the internally-mixed ingredients of such a dispensing system.

Also well known are prior-art fluid dispensing systems that externally mix ingredients (which are to be dispensed). Many dispensing systems of this type, unfortunately, are rather complex in design and/or operation, with the result being that the overall effectiveness or utility of each such dispensing system is generally uniquely encumbered by the complexity of its own design. (See, e.g., U.S. Pat. No. 1,347,520 to Rasch; U.S. Pat. No. 1,370,687 to Ferris; U.S. Pat. No. 1,590,430 to Erby; and U.S. Pat. No. 1,948,533 to Neely.) In particular, U.S. Pat. No. 1,948,533 to Neely discloses one such spraying device that is complex not only in design but also in operation.

While some prior-art piston-powered dispensing systems—such as that system disclosed in U.S. Pat. No. 2,708,600 to Froidevaux, which features external-mixing of ingredients—tout an apparent simplicity-of-design feature, many practical applications that utilize such a fluid dispensing system require inclusion of certain structural details (absent from the dispensing system disclosed by Froidevaux) which, if present, would render complex the overall dispensing system, in design and/or in operation.

In light of the sophisticated and critical nature of many of today's consumers, simplicity of design, effectiveness of operation, and overall convenience to the user, are highly desirable features or aspects of any fluid-dispensing system.

SUMMARY OF THE INVENTION

The present invention is a novel piston-powered fluid dispensing system which although extremely simple in design and operation nevertheless possesses certain aspects of features which enable a user to control flow of the fluid ingredients that are to be mixed or combined, preferably in the form of a spray or mist, external to the dispenser.

Accordingly, the elements or components of the piston-powered fluid-dispensing system of the present invention comprise (1) an apertured base, (2) a hollow, elongated cylinder, (3) an apertured piston, (4) an orificed overcap, (5) an elongated fluid passageway, (6) an apertured, hollow extension, and (7–9) three valves.

The piston, slidably engageable with the inner surface of the cylinder, divides the hollow cylinder into two chambers.

The cylinder defines a hollow neck at one end portion thereof and carries the apertured base at the other end portion thereof. The base defines an apertured sleeve.

The overcap defines an apertured throat that is slidably engageable with the inner surface of the cylinder neck. The aperture of the overcap throat provides fluid communication between one of the two cylinder chambers and a fluid-mixing region spaced from the fluid-dispensing system.

The fluid passageway, disposed through the piston aperture, provides fluid communication between a pressurized-fluid source an the fluid-mixing region via at least one orifice of the overcap. The fluid passageway and piston aperture, both preferably circular in transverse cross section, are so relatively dimensioned such that the piston is slidably engageable with the fluid passageway, substantially along the entire length thereof in a fluid-tight manner. That is, there is no substantial fluid leakage between the two chambers of the hollow cylinder via the piston aperture when the fluid passageway is disposed therethrough.

The hollow extension, slidably engageable with the inner surface of the apertured sleeve of the base, is in fluid communication with the one overcap orifice via the fluid passageway. At least one aperture of the hollow extension, when the hollow extension is disposed in the sleeve, is alignable with an aperture of the sleeve.

The first valve, carried by the base, is utilized to controllably affect flow of the pressurized fluid from the pressurized-fluid source to the fluid passageway.

The second valve, provided by movement of the extension aperture relative to the sleeve aperture, is utilized to controllably affect flow of the pressurized fluid between the fluid passageway and the other of the two cylinder chambers.

The third valve, provided by movement of the overcap throat aperture relative to the inner surface of the cylinder neck, is utilized to controllably affect flow between the other cylinder chamber and the fluid-mixing region.

Other aspects, features and advantages of the present invention are discussed in greater detail hereinbelow.

BRIEF DESCRIPTION OF THE DRAWINGS

Throughout the drawings, like reference numerals refer to like parts.

DETAILED DESCRIPTION OF THE PREFERRED EMBODIMENTS

While the present invention will now be described in connection with the various illustrated preferred embodiments, it is to be understood that the present invention is not to be limited thereto. On the contrary, as those skilled in the art can particularly appreciate, the present invention is to be understood to cover all structural or functional alternatives or equivalents as are defined by the appended claims.

BEST MODE

The following illustrated embodiments present the best mode, contemplated by the inventors, for particularly pointing out the various principles as well as other aspects, features, advantages, applications and end-uses of the piston-powered fluid-dispensing system of the present invention.

Figure 1:
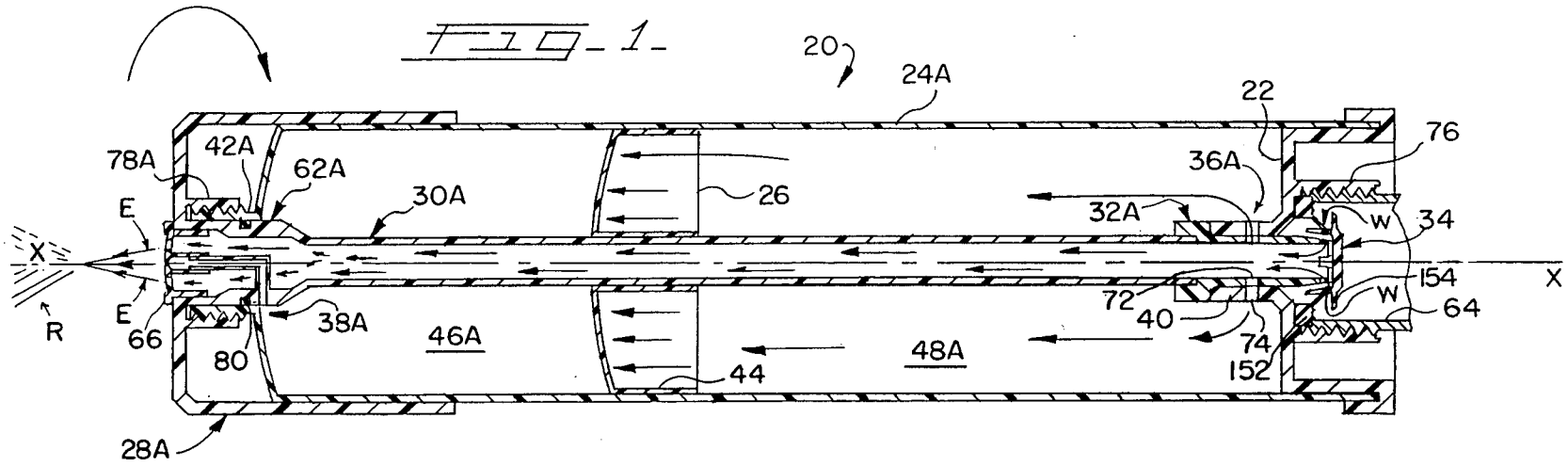
FIG. 1 is a longitudinal central sectional view, which illustrates certain features and advantages of one embodiment of the piston-powered fluid-dispensing system of the present invention, and which depicts certain elements or components (of the thus-embodied fluid-dispensing system) in one relative position.
Figure 2:
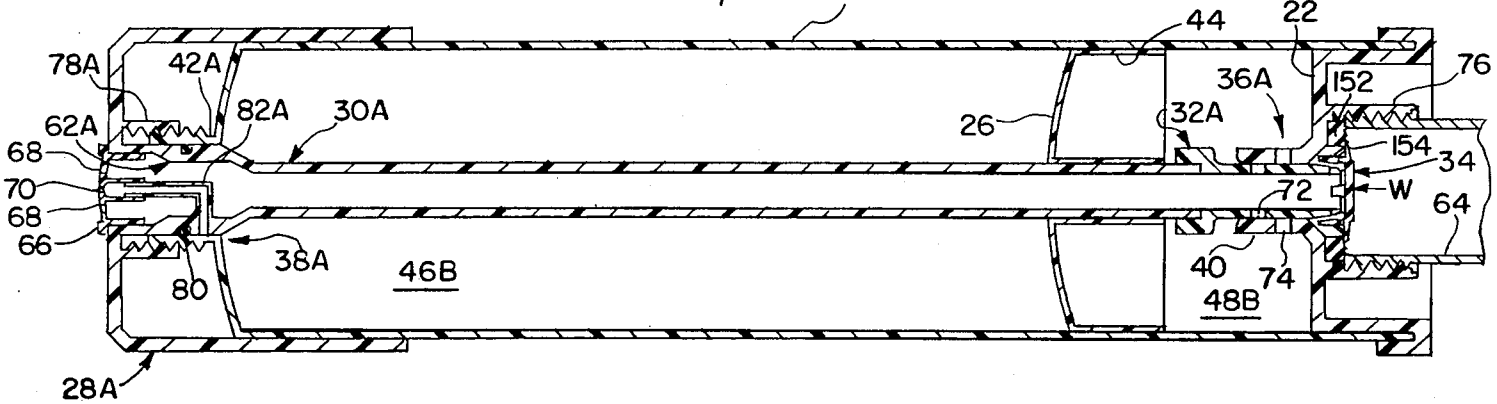
FIG. 2 is another longitudinal central section (similar to that of FIG. 1), depicting certain system elements or components of the FIG. 1 embodiment in different relative positions (with respect to what is shown in FIG. 1)

Referring initially now to FIGS. 1 and 2, there is shown one preferred embodiment of the piston-powered fluid-dispensing system 20 of the present invention. The fluid-dispensing system 20 is preferably suitably dimensioned so as to comfortably and conveniently fit into the hands of an adult human user. This allows an adult human to readily utilize and operate the same. Of course, a larger or smaller dimensioned fluid-dispensing system could readily be designed and manufactured, if desirable.

Directing attention to certain elements or components of the fluid-dispensing system 20, while still referring to FIGS. 1 and 2, it can be seen that the fluid-dispensing system 20 comprises an apertured base 22, a hollow, elongated cylinder 24A, an apertured piston 26, an orificed overcap 28A, an elongated fluid passageway 30A, a hollow, apertured extension 32A, and three valves, 34, 36A and 38A.

The base 22 defines an apertured sleeve 40. The hollow, elongated cylinder 24A, which defines a longitudinal axis X—X (FIG. 1), carries the apertured base 22 at one end portion thereof and defines a hollow neck 42A at the opposite end portion thereof.

The apertured piston 26 defines a circumferential portion 44 that is slidably engageable with the hollow cylinder 24A substantially along the length of the inner surface thereof. The apertured piston 26, disposed in the cylinder 24A, divides the inner volume of the hollow cylinder 24A into two chambers. As shown in FIG. 1, the first chamber 46A is to the left of the piston 26 and the second chamber 48A is to the right of the piston 26.

The overcap 28A, circumferentially carried by the cylinder 24A, defines an apertured throat portion 62A of the overcap 28A. The overcap throat 62A, disposable in the cylinder neck 42A, defines an exterior surface portion that is slidably engageable with an inner surface portion of the neck 42A. When the overcap throat 62A is disposed in the cylinder neck 42A, that portion of the overcap throat 62A which defines at least one aperture through the sidewall of the overcap throat 62A is movable in the direction of the longitudinal axis X—X relative to the inner surface portion of the cylinder neck 42A. (Please compare the relative displacement between the cylinder neck 42A and overcap throat 62A, as presented in FIGS. 1 and 2.)

Figure 6:
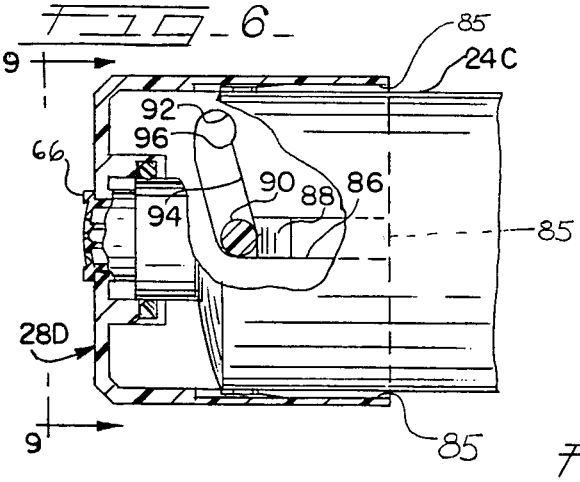
FIG. 6 is a partially-fragmented and cut-away assembled view of the embodiment shown in FIG. 5, depicting some of the fluid-dispensing system elements or components in one relative position.
Figure 8:
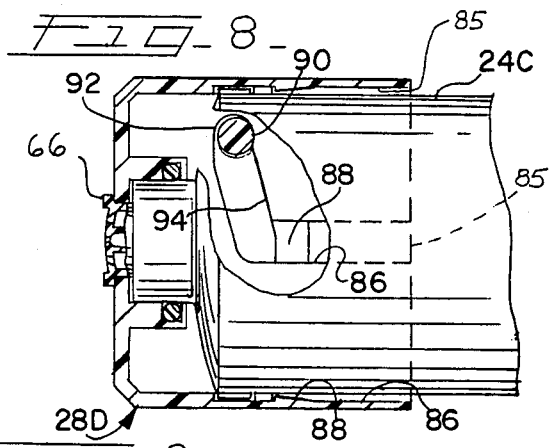
FIG. 8 is a partially fragmented view, similar to what is shown in FIG. 6, depicting the thus-embodied fluid-dispensing system elements or components in a different relative position.
Figure 7:
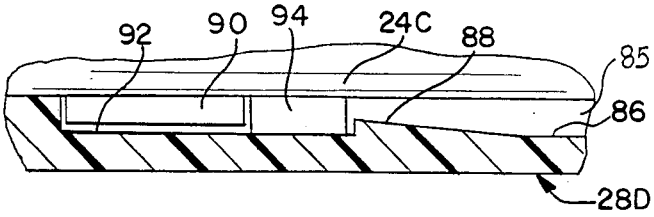
FIG. 7 is a fragmented view, on an enlarged scale relative to FIG. 6, depicting a detail shown in FIG. 6.

As is further shown in FIGS. 1 and 2, the illustrated overcap 28A includes a unitary collar 78A, which surrounds the overcap throat 62A and is concentric therewith, and which is so spaced from the throat 62A such that the cylinder neck 42A can be snugly disposed therebetween. The apertured throat 62A preferably circumferentially carries an O-ring 80, for providing a substantially fluid-tight seal between the cylinder neck 42A and the overcap throat 62A. The fluid-dispensing system 20 of the present invention can readily be modified to incorporate other O-rings at other areas of the fluid-dispensing system where various other elements are slidably engageable with each other, for providing additional substantially fluid-tight seals, as is illustrated in FIGS. 6 and 8.

The elongated fluid-passageway 30A is removably disposed through the aperture of the piston 26, in a substantially fluid-tight manner, and is in fluid communication with the overcap throat 62A. The internal transverse cross-sectional area of the fluid passageway 30A is less than the effective (i.e., annular) cross-sectional area of the piston 26.

A pressurized-fluid source (not shown) is in fluid communication with the base 22 via a conduit 64. Preferably, the base 22 and conduit 64 are secured together utilizing mated, screw-threaded engaging surface portions of each, as is indicated in FIGS. 1 and 2. In particular, in the illustrated embodiment, the base 22 further defines an integral threaded connection 76 which surrounds the aperture of the base 20. The connection 76, in turn, defines internal screw threads that are so configured as to mate with threads of conduit 64 in a fluid-tight manner whereby the conduit 64 can readily be removably joined to the base 22 of the fluid-dispensing system 20.

Figure 9:
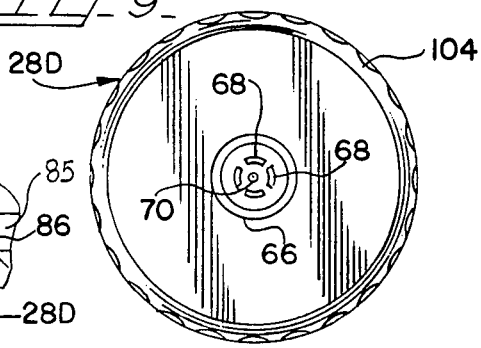
FIG. 9 is an end view, taken along the line 9—9 in FIG. 6.

An orificed nozzle 66, carried by the overcap 28A, provides the throat 62A with a plurality of orifices 68 and 70. (FIGS. 2 and 9.) At least one orifice 68 of the overcap 28A (FIGS. 1 and 2) is in flow-controllable fluid communication with the pressurized-fluid source via the fluid passageway 30A. Further, such orifice 68 provides fluid communication between the pressurized-fluid source (not shown) and a fluid-mixing or fluid-combining region ("R") spaced from the fluid-dispensing system 20 of the illustrated embodiment (i.e., shown on the left in FIG. 1). The first chamber 46A of the cylinder 24A is in flow-controllable fluid communication with the fluid-mixing region R (see, e.g., FIG. 1) via orifice 70 (please refer to FIGS. 2 and 9) of the overcap 28A.

The hollow, apertured extension 32A, disposable in the sleeve 40 of the base 22, is in fluid communication with the throat 62A of the overcap 28A via the fluid passageway 30A. The hollow extension 32A, which defines an exterior surface portion that is slidably engageable with the inner surface portion of the sleeve 40, when disposed in the sleeve 40, is movable relative to the sleeve 40 in the direction of the longitudinal axis X—X (FIG. 1) of the cylinder 24A. (Compare FIGS. 1 and 2.) When the hollow extension 32A is disposed in the sleeve 40, at least one aperture 72 of the extension 32A is alignable with an aperture 74 that is formed through the sidewall of sleeve 40.

The first valve 34, carried by the base 22, is utilized for controllably effecting flow of the pressurized fluid from the pressurized-fluid source to the fluid passageway 30A. While the various elements of the first valve 34 will more particularly be described hereinbelow, the following brief comments can be made at this juncture. The first valve 34 is so dimensioned relative to the threaded connection 76 (of the base 22) and the conduit 64 as to be disposable therebetween. The valve 34, moreover, is preferably so configured as to include an annular so-called "washer" portion 152 (see, e.g., FIGS. 1 and 2; see also FIGS. 15 and 16) that is urged by conduit 64 into a recess formed within the threaded connection 76, for providing another fluid-tight seal between conduit 64 and threaded connection 76 when the first valve 34 is in its "closed" position, as is shown in FIG. 2. It can be appreciated that a suitable fluid flow-check device (not shown) can be incorporated into conduit 64 or located upstream therefrom, to prevent siphoning of fluid from the fluid-dispensing system back to the pressurized-fluid source.

The second valve means 36A, provided by movement in the direction of the longitudinal axis X—X (of the cylinder 24A), of one of the apertured extension 32A and the apertured sleeve 40 relative to the other (with the hollow extension 32A disposed in the sleeve 40), is utilized for controllably affecting flow of the pressurized fluid between the fluid passageway 30A and the second cylinder chamber 48A (see, e.g., FIG. 1).

That particular embodiment of the apertured extension 32A, which is shown in FIGS. 1 and 2, is so specifically configured as to be removably joined to one end portion of the fluid passageway 30A. Because the other end portion of the particular embodiment of the fluid passageway 30A (that is shown in FIGS. 1 and 2) is unitary with the illustrated overcap throat 62A, it can be appreciated that relative movement as between the cylinder neck 42A and overcap throat 62A, as is caused by rotation of one of the overcap 28A and cylinder 24A about the longitudinal axis X—X relative to the other, will cause the aperture 72 of the hollow extension 32A to move relative to the aperture 74 of the sleeve 40. It can further be appreciated that such relative movement of these apertures 72 and 74 will, in turn, cause the second valve means 36A to move between its "open" (FIG. 1) and "closed" (FIG. 2) positions.

The third valve means 38A, provided by movement in the direction of the longitudinal axis X—X of one of the cylinder neck 42A and apertured portion of the overcap throat 62A (with the apertured throat 62A disposed in the cylinder neck 42A), is utilized to controllably affect fluid flow between the first chamber 46A of the cylinder 24A and the fluid-mixing region R. (See, e.g., FIG. 1.)

In that embodiment (of the present invention) which is shown in FIGS. 1 and 2, the cylinder neck 42A and the overcap collar 78A are provided with mated, engaging threaded portions, whereby rotation of the overcap 28A about the longitudinal axis X—X (FIG. 1) relative to the cylinder 24A causes movement, in the direction of the longitudinal axis, of one of the overcap 28A and cylinder 24A relative to the other. This can be seen by comparing the spatial relationship differences, in FIGS. 1 and 2, between cylinder neck 42A and apertured throat 62A. Indeed, as overcap 28A is rotated relative to cylinder 24A, as above described, thereby to cause the aperture of throat 62A to move relative to the inner surface of the cylinder neck 42A (with which it is in sliding engagement), it will be understood that such rotation causes the third valve 38A either to open (FIG. 1) or close (FIG. 2).

Reference to FIGS. 13 through 16 is now invited for the purpose of briefly discussing valve 34. U.S. Pat. No. 4,583,688 to Crapser (and assigned to S. C. Johnson & Son, Inc., of Racine, Wis.) is hereby incorporated by reference.

While valve 34 is disclosed and described in the above cited U.S. Pat. No. 4,583,688 to Crapser, brief mention can be made at this juncture, to provide the present patent specification with a full disclosure, without need to refer to the '688 patent. Accordingly, valve 34 comprises the above-mentioned annular washer portion 152, a center-button portion 154, a radially-disposed inner-edge portion 156, and an interconnecting portion 158. (Please refer, in particular, to FIGS. 15 and 16.)

Figure 15:
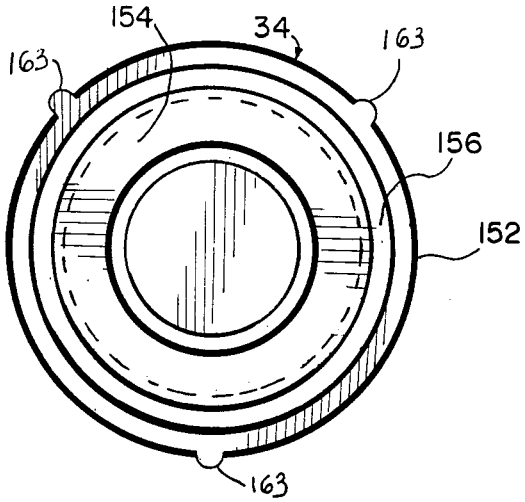
FIG. 15 is a top plan view, on an enlarged scale, of a valve shown, e.g., in FIGS. 1 and 2.
Figure 16:
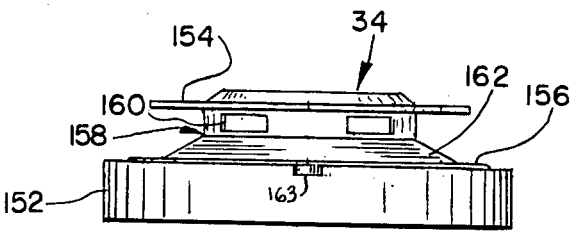
FIG. 16 is a side elevational view of the valve shown in FIG. 15.

The annular washer portion 152 is so configured and positioned within the threaded connection 76 of the base 22 as to be terminally urgeable by conduit 64 into the above-mentioned recess formed in threaded connection 76. (Please refer to FIGS. 1 and 2.) The interconnecting portion 158, which is unitary with both the button portion 154 and washer portion 152, includes a hollow, cylindrical section (which defines apertures 160) and a frusto-conical, flexible webbing section 162. (FIG. 16.) Optionally, valve 34 can include a plurality of circumferentially-spaced radially-disposed ears 163, unitary with the washer portion 152, if desired. (FIGS. 15 and 16.)

The external diameter of the button portion 154 is greater than the internal diameter of the inner edge portion 156 of washer 152. (FIGS. 15 and 16.) The result is that when button 154 engages washer 152 (FIG. 14), the flow of the pressurized fluid, such as pressurized water W, through valve 34 is thus blocked. Such engagement between button 154 and washer 152 occurs, it will be noted, when button 154 is in a downstream axial position relative to washer 152. When, however, button 154 is displaced to an upstream position relative to washer 152 (FIG. 13), is permitted to pass through apertures 160. (Please also compare FIGS. 14 and 16.) Conversely, because valve 34 is so formed as to include—as a unitary element or component—the webbing 162, the presence of such flexible webbing 162 thus enables the hollow extension 32B (shown in FIG. 14 as abuttingly engaging valve 34) to cause button 154 and inner edge 156 to become spaced apart when passageway 32A is moved relative to sleeve 40, thereby causing valve 34 to open. (Please compare FIGS. 13 and 14.)

Valve 34 is accordingly manufactured from a suitable, resiliently-deformable substance such as natural rubber, synthetic rubber, or another suitable elastomeric polymeric material.

A preferred pressurized-fluid source, for the piston-powered fluid-dispensing system of the present invention, is a pressurized-water source (not shown). With valve 34 in its "closed" position (FIG. 2), pressurized water W exerts force on one side of valve 34. When conduit 64 urges valve 34 into engagement with the above-described inner recess of threaded connection 76, and with valve 34 in its "closed" position, no water is able to pass valve 34 and enter the other elements or components of the fluid-dispensing system 20.

As mentioned above, when the button portion 154 of valve 34 sealingly overlies the annular washer portion 152 (as is shown in FIG. 2), the first valve 34 is closed. As FIG. 2 illustrates, the second valve means 36A and third valve means 38A are both also closed, when the first valve 34 is in its "closed" position.

Initially, the first chamber 46B (see, e.g., FIG. 2) defines a major portion of the total volume of hollow cylinder 24A. Such chamber 46B is designed or otherwise adapted to contain a fluid that the user wants to dispense. Such fluid can be a medicinal composition, a disinfectant, a fungicide, a repellent, or another fluid chemical composition such as an insecticide, a fertilizer, and the like. The term "fluid chemical composition" as used throughout this patent specification includes a flowable gel. Preferably, the first chamber 46B contains a fluid lawn-and-garden type of fluid chemical composition such as a fertilizer, a herbicide, an insecticide, or the like; and the various elements or components of the fluid-dispensing system 20 (which are in contact therewith) are manufactured from a material or substance that is not corroded, dissolved, or otherwise affected by the fluid chemical composition contained within first chamber 46B.

As can be appreciated, the presence of a pressurized fluid such as pressurized water W in conduit 64 tends to force button portion 154 of valve 34 into engagement with the annular washer portion 152. It can further be appreciated, when the button portion 154 of valve 34 is thus forced into sealingly-overlying engagement with the annular washer portion 152, that an end portion of the apertured extension 32A abuttingly engages that side of valve 34 which is opposite the the pressurized side of valve 34, which side of valve 34 is thus under pressure as a result of the presence of pressurized water W in conduit 64. It will be noted, referring momentarily to FIG. 2, that as the apertured extension 32A is moved slightly to the right relative to the sleeve 40 of base 22 (so as to "crack open" valve 34), that such end portion of extension 32A, which thus abuttingly engages valve 34, will cause the washer and button portions 152 and 154 of valve 34 to become spaced apart, thereby allowing pressurized water W to pass therebetween and through the apertures 160 (FIG. 16). Such pressurized water W is also free to flow through the passageway 30A and overcap throat 62A, thereby dispensing water from the fluid dispensing system 20 via the orifices 68 (FIG. 1).

Generally, it is desirable to so space the apertures 72 of extension 32A relative to the apertures 74 of sleeve 40, and the aperture through the sidewall of overcap throat 62A relative to the inner surface of cylinder neck 42A, such that the second valve means 36A can be cracked open while the third valve means 38A remains closed. It is also desirable (from, e.g., the standpoint of safety) that pressurized water W in fluid passageway 30A be permitted to flow into, fill and pressurize the second chamber 48B (see, e.g., FIG. 2) of the cylinder 24A while the third valve means 38A still remains substantially closed.

Relative size and/or spatial relation of each of the above-described elements or components (of the fluid-dispensing system) which provide the second and third valve means 36A and 38A is, of course, a matter of design choice; but generally, the various fluid-dispensing system elements or components providing the second and third valve means 36A and 38A will be so designed such that the second and third valve means 36A and 38A remain closed when the first valve 34 is "cracked open", as briefly described above.

Furthermore, the nozzle 66 preferably has the water-dispensing orifices 68 equally spaced about the chemical-dispensing orifice 70 (FIG. 9) so as to provide a predetermined, desired spray pattern, such as the spray pattern defining the angle "E", as is shown in FIG. 1. Still further, the orifices 68 and 70 can be so formed in nozzle 66 as to provide a desired spray pattern having a desired, preselected fluid chemical composition-to-diluent (e.g. water) ratio as well. Thus, and in accordance with one of the principles of the present invention, a variety of different, orificed nozzles can be selected—each such nozzle providing a unique, desired dilution ratio of chemical composition-to-diluent—regardless of the pressure of the pressurized fluid that is utilized.

The manner of removably joining the apertured base 22 to the hollow cylinder 24A is also a matter of design choice. That is, the base 22 and cylinder 24A can permanently be joined together such as by being spin-welded together. Such a manner of affixing the base 22 to the cylinder 24A is preferable if the fluid-dispensing system is marketed as a pre-filled one-time-use article. Generally, however, the base 22 and cylinder 24A can removably be joined together in a variety of other ways. For example, in certain situations, it will be desirable for the base 22 and cylinder 24A, initially fitted together in a substantially fluid tight manner, to become forced apart when fluid pressure in the second chamber 48B (see, e.g., FIG. 2) becomes is greater than a predetermined value. The various components or elements of the fluid dispensing system 20—in particular the sidewalls of cylinder 24A—are generally relatively dimensioned and fabricated from a suitable substance or material such that overpressurization of the second chamber 48B (see, e.g., FIG. 2) beyond such a predetermined pressure value, would rarely, if ever, occur.

That particular embodiment of the fluid-dispensing system of the present invention, that is shown in FIGS. 1 and 2, can be operatively assembled as follows.

With the orificed nozzle 66 fitted into overcap troat 62A (in the substantially fluid-tight manner mentioned above), and with the overcap throat 62A circumferentially carrying the O-ring 80, the cylinder neck 42A and overcap collar 78A can be brought into engagement in a manner such that the third valve means 38A is closed, as is shown in FIG. 2. (It will be noted that the fluid passageway 30A is shown as being unitary with the overcap throat 62A in this particular embodiment.) The desired fluid chemical composition that is to be dispensed can then be transferred into the first chamber 46B (see, e.g., FIG. 2), taking care that such fluid chemical composition is not inadvertently or otherwise introduced into fluid passageway 30A. Once the desired amount of fluid chemical composition is thus transferred into first chamber 46B, the apertured piston 26 can then be disposed into hollow cylinder 24A. The fluid passageway 30A is next disposed through the aperture of piston 26; and a sufficient length of the fluid passageway 30A extends through the piston 26 so as to affix the apertured extension 32A thereonto. Then, disposing the apertured extention 32A into the apertured sleeve 40 (of cylinder base 22), the base 22 can be brought into engagement with the open-end portion of cylinder 24A in a fluid-tight manner, as desired.

Still generally referring to FIGS. 1 and 2 (except where noted), operation of the illustrated fluid-dispensing system 20 will now briefly be summarized. In the discussion appearing immediately below, the pressurized fluid is pressurized water.

With the first chamber 46B thus-filled with the desired fluid chemical composition (which the user desired to dispense)—and with the three valves 34, 36A and 38A closed (FIG. 2)—the user can, while holding the cylinder 24A with one hand, then rotate the overcap 28A (relative to the cylinder 24A with the other hand) about longitudinal axis X—X, thereby causing valve 34 and, thereafter, valve 36A to sequentially become cracked open. Such rotation of these components or elements of the fluid-dispensing system 20 will cause pressurized water W to pass through fluid passageway 30A and be dispensed from the fluid dispensing system 20 via the apertures 68. As the second valve 36A thus is caused to open, the second chamber 48B (see, e.g., FIG. 2) will also fill with pressurized water W and thus become pressurized. As second chamber 48B becomes pressurized, the pressure in chamber 48B will act upon piston 26, causing piston 26 to move to the left as soon as the third valve means 38A is opened. (Please compare FIGS. 1 and 2.) As soon as the third valve 38A is opened by further rotation of the overcap 28A relative to the cylinder 24A, the pressure in the second chamber 48B thus acts upon the piston 26, thereby causing piston 26 to urge the desired fluid chemical composition out of the first chamber 46B (see, e.g., FIG. 2) and through the nozzle orifice 70 (see, e.g., FIG. 1). Thus, in operation, the volume of the first (or chemical composition-containing) chamber 46A is continuously decreasing while the volume of the second (or pressurized water-containing) chamber 48A is continuously increasing, as a result of the motion of piston 26 within cylinder 24A (please compare FIGS. 1 and 2).

In certain applications, it will be desirable to so manufacture and/or so design the fluid-dispensing system such that the re-filling of hollow cylinder 24A with a particular fluid chemical composition by the general public is discouraged and accordingly generally relatively unlikely. For example, it may be necessary to so design the fluid-dispensing system such that disassembly of the fluid-dispensing system component parts is virtually impossible, because, e.g., of certain physical properties of a particular fluid chemical composition that is contained within the cylinder.

Accordingly, for such applications, and for certain consumers (such as those who do not want to come into contact with the chemical ingredient), one preferred method for manufacturing the fluid-dispensing system contemplates pre-filling the cylinder with a suitable chemical ingredient and thereafter permanently affixing the base to the cylinder. A conventional spin-welding technique can be used, for such a purpose. From discussion contained herein, it can be appreciated that the overcap, overcap throat, fluid passageway, and apertured extension (disposable in the sleeve of the base) can all be manufactured as a single unitary piece, for such a purpose.

Figure 3:
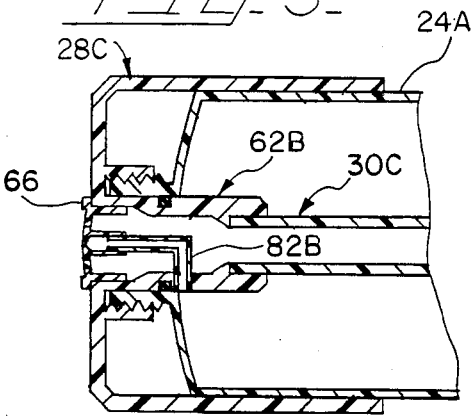
FIG. 3 is a partially-fragmented longitudinal section, depicting some of the fluid-dispensing system elements or components in the FIG. 1 position, and illustrating an alternative embodiment of certain elements or components shown in FIGS. 1 and 2.

Yet in other applications, it will be desirable for a member of the general public to be able to re-use, and thus be able to re-fill, the fluid-dispensing system of the present invention. Accordingly, the base and cylinder can each readily be so designed as to be screwable or snap-engageable together (details not shown), as desired. Yet, for certain other consumers, it will be desirable to produce the dispensing system 20 so that additional component parts thereof are readily dis-assemblable, to accommodate a wide variety of consumer needs. For example, overcap throat 62B can be so formed as to be removably engageable with each of the fluid passageway 30C, the nozzle 66, and the L-shaped internally-contained fluid passageway 82B, in a substantially fluid-tight manner. (FIG. 3.) These components can be press-fitted or snap-engaged together to enable the consumer to produce the desired spray pattern see, e.g., FIG. 1).

Figure 12:
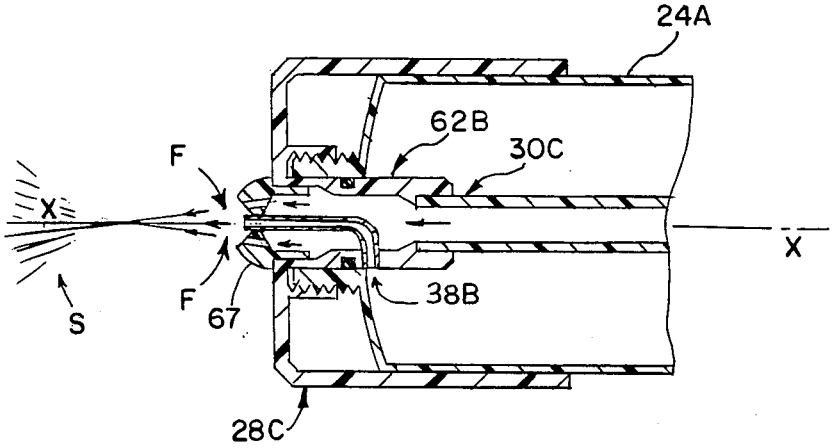
FIG. 12 is yet another partially-fragmented longitudinal section, illustrating an alternative embodiment of some of the fluid-dispensing system elements or components shown, e.g., in FIGS. 1 and 2.

Still further, the orificed nozzle and overcap throat can readily both be so designed as to provide substantially fluid-tight engagement between these parts, when the dispensing system nozzle is disposed in the overcap throat, until a predetermined pressure is reached in fluid passageway 30A. Upon achieving such a pressure, the thus-designed nozzle would become separated from the overcap throat, thereby relieving such a pressure buildup. The consumer can thus replace one component part with another if desired. For example, for certain applications, it will be desirable to replace the elongated fluid passageway and/or the L-shaped fluid passageway so as to change the chemical-to-water ratio range from one desired, predetermined range (or single value) to another. Yet in certain other applications it will be desirable to replace the illustrated nozzle 66 with still another nozzle 67 (FIG. 12) to provide an entirely different spray pattern—such as the spray pattern defining the angle "F"—at an entirely different region "S", as is shown in FIG. 12).

The present invention provides the sophisticated consumer with a simple-to-operate fluid-dispensing system which possesses numerous desirable features, as can be appreciated from the above-presented discussion. The present fluid-dispensing system, for example, provides a 2-compartmented hollow cylinder, a rotatable cap on one end of the cylinder, and an internal water-supply channel that is disposed through both cylinder compartments. One compartment is adapted to contain a concentrated chemical ingredient. The other compartment is adapted to contain a pressurized fluid, preferably pressurized water. Such water is preferably supplied to the cylinder via a conventional residential garden hose. In one embodiment, the water-supply channel is necked-down to create a back-pressure in the water-supply channel so as to favor flow of water into the pressurizable compartment. This also tends to reduce fluid pressure in the overcap throat, which is desirable (in certain situations), as can be appreciated.

A slidable piston, separating the chambers, and set in motion by pressure build-up in the pressurizable chamber, forces the concentrated chemical out of the other chamber. Within the fluid-dispensing system, the dilutable concentrated ingredient and the pressurized diluting fluid (i.e. water) flow through separate fluid passageways. Separate orifices receive these fluid flows; and rotation of the overcap (relative to the cylinder) externally-mixes the ingredients, enabling the user to dispense the mixture—in the form of a spray or mist—at a desired dispensing area or region. Thus, by simply rotating the overcap relative to the cylinder, the user can controllably dispense a mixture having a product-to-water ratio that is within a desired predetermined range. Still further, rotation of the overcap in the opposite direction closes the valves, thereby enabling the user to store the dispensing system for a period of time—for several months, e.g,—if desired.

Please refer to the remainder of the drawing figures so that other preferred embodiments as well as certain other features and advantages of the fluid dispensing system of the present invention can now briefly be discussed.

Figure 13:
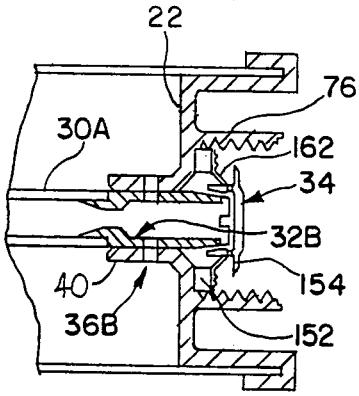
FIG. 13 is a partially-fragmented sectional view, illustrating certain elements or components of yet another embodiment (of the dispensing system of the present invention) in one relative position.
Figure 14:
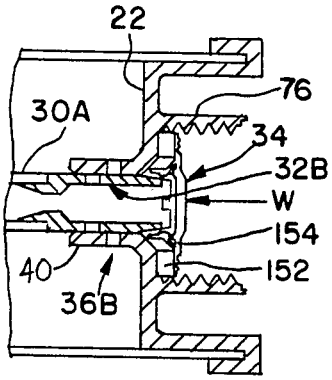
FIG. 14 is a partially-fragmented sectional view presenting certain elements or components of the FIG. 13 embodiment in different relative positions.

In certain situations, it is desirable to so form the above-described apertured extension 32A such that the hollow extension 32A is able to receive the free-end portion of the fluid passageway 30A (FIGS. 1 and 2) and be removably joined thereto, as discussed above. In certain other situations, however, it is desirable to so form this element or component of the fluid-dispensing system such that the hollow, apertured extension 32B is disposable into the free-end portion of the fluid passageway 30A. (FIGS. 13 and 14.) In still other situations it is desirable to so form the fluid passageway 30B and apertured extension 32C so as to have the hollow extension 32C be unitary with the fluid passageway 30B. (FIG. 11.)

Figure 11:
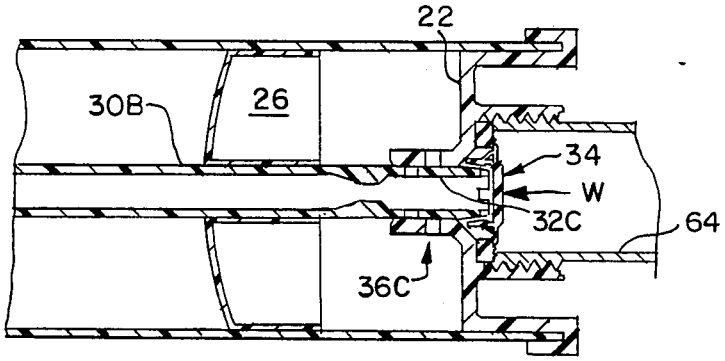
FIG. 11 is still another partially-fragmented longitudinal section, illustrating an alternative embodiment of certain fluid-dispensing system elements or components shown, e.g., in FIGS. 1 and 2.

Further, while some fluid-dispensing situations do not require modifying the internal cross-sectional area of hollow extension 32A (FIGS. 1 and 2), it can be appreciated that certain other such situations will require that the inner cross-sectional area of hollow extension 32B (FIGS. 13 and 14) or hollow extension 32C (FIG. 11) be reduced so as to create sufficient back-pressure in fluid passageway 30A (FIGS. 13 and 14) or in fluid passageway 30B (FIG. 11), respectively, so as to cause pressurized fluid, such as pressurized water W, to flow preferentially through the one illustrated embodiment of the second valve means 36B (FIG. 13 or 14), or through the other illustrated embodiment of the second valve means 36C (FIG. 11), instead of through the one respective fluid passageway 30A (FIGS. 13 and 14), or through the other respective fluid passageway 30B (FIG. 11).

Still further, the overcap throat 62A, as described above in connection with FIGS. 1 and 2, is shown as being unitary with fluid passageway 30A. For a variety of reasons, however, it is desirable, in yet other fluid-dispensing situations, to so form the overcap element or component of the fluid-dispensing system of the present invention such that the overcap throat 62B and fluid passageway 32C are separate parts or components, which are able to be removably fitted together in substantially fluid-tight engagement. (See, e.g., FIG. 3.)

In connection with the above-mentioned third valve means 38A (please refer, e.g., to FIG. 2), that portion of the overcap throat 62A which defines the throat aperture has been described as being in fluid communication with orifice 70 of nozzle 66. Such fluid communication is shown to exist as a result of the presence of an L-shaped fluid passageway 82A (FIG. 2) disposed within the overcap throat 62A. In particular, the illustrated L-shaped fluid passageway 82A is depicted as being unitary with the overcap throat 62A at one end portion of the fluid passageway 82A. At the other end portion of the L-shaped fluid passageway 82A, the passageway 82A and the orifice nozzle 66 are depicted as being removably fitted together in a substantially fluid-tight manner. Yet in still other fluid-dispensing situations, it can be appreciated that it is desirable to so form these components or elements of the fluid dispensing system 20 such that the L-shaped fluid passageway 82B and the orificed throat 62B are separate pieces or components, fitted together in a substantially fluid-tight manner, as is shown in FIG. 3. Another variation of such an L-shaped fluid passageway is shown in FIG. 12.

Figure 4:
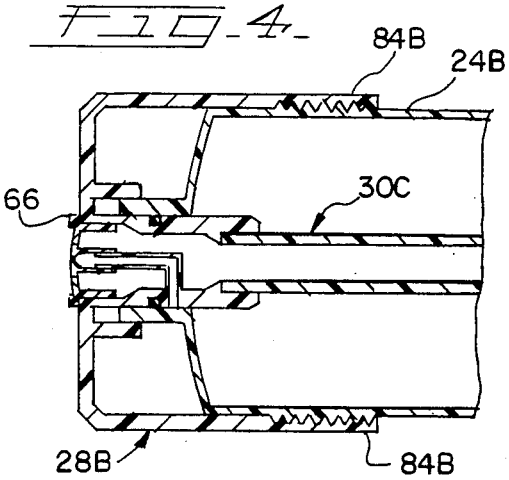
FIG. 4 is another partially-fragmented longitudinal section, depicting some of the fluid-dispensing system elements or components in the FIG. 2 position, and illustrating still another embodiment of the fluid-dispensing system of the present invention.
Figure 5:
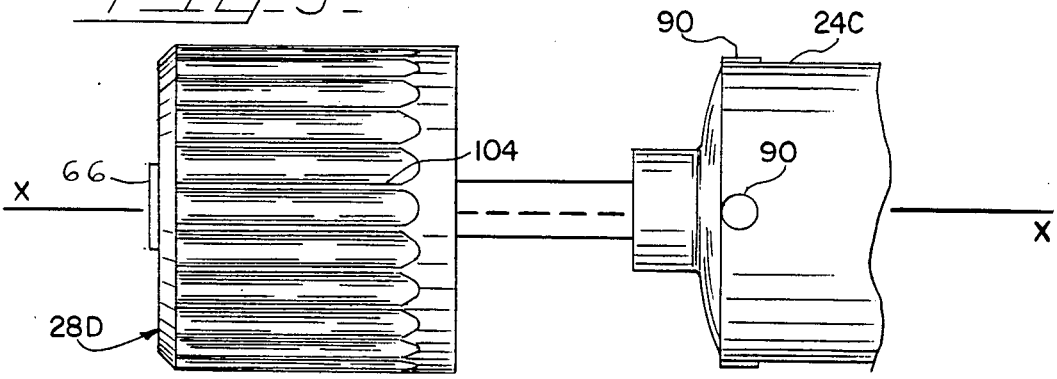
FIG. 5 is an exploded and partially-fragmented view, depicting yet another embodiment of the fluid-dispensing system of the present invention.

Certain discussion presented above, concerning the embodiment of the fluid-dispensing system of the present invention, as shown in FIGS. 1 and 2, particularly points out that engaging portions of the cylinder neck 42A and overcap collar 78A can be so formed as to include engaging, mated screw-thread portions whereby rotation of one of the overcap 28A and hollow cylinder 24A causes the above-described relative movement between these elements or components of the fluid-dispensing system 20. (Please see, e.g., FIGS. 1 and 2.) Referring now briefly to FIG. 4, however, it can be appreciated that yet another embodiment of the overcap 28B and cylinder 24B can both be so formed as to be rotatably joined together in a different manner. In particular, it will be noted that the overcap 28B can define edge margins 84B (FIG. 4), so configured as to provide a generally cup-shaped receptacle that is substantially circular in transverse cross section (see, e.g., FIG. 9), and so dimensioned relative to the cylinder 24B (FIG. 4) as to circumferentially engage an exterior surface portion of cylinder 24B when the necked-end portion of cylinder 24B is disposed into overcap 28B, as is shown in FIG. 4. Still more particularly, it will be noted that such engaging surface portions of cylinder 24B and overcap 28B are provided with mated, screw-threaded engaging-surface portions (FIG. 4) that provide a substantially fluid-tight seal therebetween.

It is additionally contemplated, in accordance with the principles of the present invention, that the overcap and cylinder can each be provided with still other engageable leveraging means, for causing one of the overcap and cylinder to be displaced along the cylinder longitudinal axis relative to the other when either one of the overcap or cylinder is rotated about the longitudinal axis relative to the other. Accordingly, brief reference to FIGS. 5–8 is now invited, so that yet another embodiment of the engageable leveraging means (for the overcap-and-cylinder combination) can now briefly be discussed.

In such embodiment, which is preferred in certain situations (as will be appreciated from discussion appearing hereinbelow), the overcap 28D (FIG. 5) is so formed as to define cam tracks 85 within predetermined internal sidewall portions thereof (FIGS. 6 and 8). The illustrated embodiment of the overcap 28D, accordingly, preferably internally defines four such cam tracks 85, each such cam track being equally spaced from its two nearest neighbors within the inner periphery of the overcap 28D. (FIG. 6.) The hollow cylinder 24C of the illustrated embodiment (FIG. 5), in turn, is so formed as to define four circumferentially equally-spaced lobes or protuberances 90, radially-disposed and outwardly extending from the exterior surface of the cylinder 24C.

Moreover, this particular embodiment of the present invention can be so manufactured as to enable a consumer to readily obtain a preselected, desired chemical-to-water mixing ratio, as will be described hereinbelow. Brief mention can be made at this juncture, however, to point out that the overcap 28D is preferably formed so as to define a plurality of longitudinal grooves 104 equally circumferentially spaced about the exterior surface portion of the overcap 28D (FIGS. 5 and 9), for such a purpose.

Referring now back to the above-mentioned cam track 85 (please refer to FIGS. 6–8), it will be noted that the cam track 85 preferably comprises an entrance channel 86 and a ramp 88 (FIGS. 7 and 8), both so dimensioned and so formed within the inner surface of the overcap 28D as to accommodate lobes or protuberances 90 (FIG. 5) that are unitary with the cylinder 24C. Preferably, the cylinder 24C has four such lobes 90 equally circumferentially spaced about that exterior surface portion of hollow cylinder 24C which is to be inserted into overcap 28D. The illustrated cam tracks 85 each further comprise an arcuate region 92 for retaining the lobe 90 therein, a transverse channel 94 providing access (for the lobe 90) from ramp 88 to arcuate region 92, and a cusp 96 (FIG. 6) between arcuate region 92 and transverse channel 94, for retaining the lobe 90 in the arcuate region 92, all such hereinabove-identified elements of each cam track 85 being formed within the overcap 28D. (See, e.g., FIGS. 6 and 8.) The overcap 28D is retained on the cylinder 24C (FIG. 5) by forcing the retaining lobes 90 past the retaining ramps 88 (FIG. 7) and into the transverse channel 94 (FIG. 6).

Figure 10:
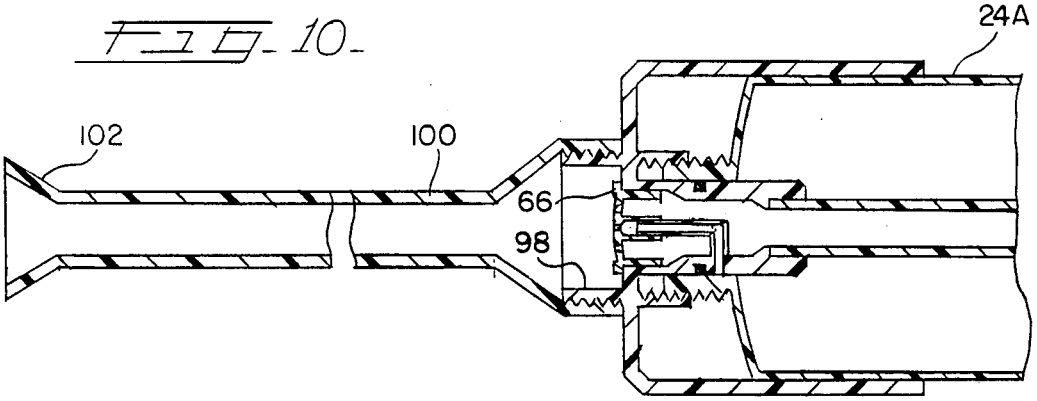
FIG. 10 is a partially-fragmented longitudinal section, illustrating yet another embodiment as well as certain other aspects and features of the fluid-dispensing system of the present invention.

For certain other fluid-dispensing applications, the overcap of the present invention is so formed as to define an exterior collar 98, surrounding the nozzle 66, and so disposed as to extend outwardly therefrom (FIG. 10). The illustrated exterior collar 98 is seen to include exterior threads that mate with interior threads of a hollow, elongated, exterior member (i.e., a so-called "wand") 100 having flared end 102. The consumer makes use of wand 100 when it is desirable to apply the dispensed mixture to an otherwise inaccessible region or area. The wand 100 can, of course, be manufactured so as to be of suitable length for such a purpose.

What has been illustrated and described herein is a novel piston-powered fluid-dispensing system. While the fluid-dispensing system of the present invention has been described with reference to a number of preferred embodiments, it is to be understood that the present invention is not to be limited thereto. For example, the cylinder can be produced from a transparent or translucent material, if desired; and the cylinder can be formed as to include numbered relative-amount graduations, thereby providing means for visably informing the user of the relative amount of fluid chemical composition, present within the cylinder before and after use. Such a feature thus enables a consumer (or other such user) to known generally how much of the fluid chemical composition has been dispensed and how much remains in the cylinder (of the fluid-dispensing system of the present invention).

Accordingly, alternatives, changes and modifications will become apparent to those skilled in the art upon reading the foregoing description. Accordingly, such alternatives, changes and modifications are to be considered as forming a part of the present invention insofar as they fall within the spirit and scope of the appended claims.

We claim:

1. A piston-powered dispensing system comprising:

an apertured base defining an apertured sleeve;

a hollow, elongated cylinder carrying the base at one end portion thereof and defining a hollow neck at an opposite end portion thereof;

an apertured piston defining a circumferential portion that is slidably engageable with the hollow cylinder substantially along the length of an inner surface thereof and disposed in the cylinder for dividing the cylinder into at least two chambers;

an orificed overcap defining an apertured throat, wherein the overcap throat is slidably engageable with an inner surface portion of the cylinder neck, whereby the throat aperture of the overcap throat provides fluid communication between one of the two cylinder chambers and a fluid-mixing region spaced from the dispensing system;

an elongated fluid passageway means disposed through the piston aperture in a fluid-tight manner, wherein the fluid passageway means provides fluid communication between a pressurized-fluid source and the fluid-mixing region via at least one orifice of the overcap;

an apertured, hollow extension in fluid communication with the one overcap orifice via the fluid passageway means and slidably engageable with an inner surface portion of the sleeve of the base, at least one aperture of the hollow extension being alignable with an aperture of the sleeve when the extension is disposed in the sleeve;

first valve means, carried by the base, for controllably affecting flow of a pressurized fluid from the pressurized-fluid source to the fluid passageway means;

second valve means, provided by movement of the extension aperture relative to the sleeve aperture, for controllably affecting flow of the pressurized fluid between the fluid passageway means and the other of the two cylinder chambers; and third valve means, provided by movement of the overcap throat aperture relative to the inner surface of the cylinder neck, for controllably affecting flow between the other cylinder chamber and the fluid-mixing region.

2. A piston-powered fluid dispensing system, wherein the fluid dispensing system is spaced from a fluid-mixing region, and wherein the fluid dispensing system comprises:

an apertured base defining an apertured sleeve;

a hollow, elongated cylinder defining a longitudinal axis, wherein the hollow cylinder carries the apertured base at one end portion thereof and defines a hollow neck at the opposite end portion thereof;

an apertured piston defining a circumferential portion that is slidably engageable with the hollow cylinder substantially along the length of an inner surface thereof, the apertured piston being disposed in the cylinder and thereby dividing the hollow cylinder into two chambers;

an orificed overcap circumferentially carried by the cylinder, wherein the overcap defines an apertured throat portion that is slidably engagable with a portion of an inner surface of the cylinder neck, and wherein the apertured portion of the overcap throat is movable in the direction of the longitudinal axis relative to the cylinder neck inner surface portion when the overcap throat is disposed in the cylinder neck;

an elongated fluid passageway means removably disposed through the piston aperture in a fluid-tight manner and in fluid communication with the overcap throat, the cross-sectional area of the fluid passageway means being less than the cross-sectional area of the piston, at least one orifice of the overcap being in flow-controllable fluid communication with a pressurized-fluid source via the fluid passageway means, the one overcap orifice providing fluid communication between the pressurized-fluid source and the fluid-mixing region, one of the two chambers being in flow-controllable fluid communication with the fluid-mixing region via at least one other orifice of the overcap;

an apertured, hollow extension, wherein the hollow extension is in fluid communication with the overcap throat via the fluid passageway means, wherein the extension is disposable in the sleeve of the base and is slidably engageable with an inner surface portion of the sleeve in the direction of the longitudinal axis of the cylinder, and wherein at least one aperture of the extension is alignable with an aperture of the sleeve when the extension is disposed in the sleeve;

first valve means, carried by the base, for controllably affecting pressurized-fluid flow from the pressurized-fluid source to the fluid passageway means;

second valve means, provided by movement in the direction of the longitudinal axis of the extension aperture relative to the sleeve aperture, when the extension is disposed in the sleeve, for controllably affecting flow of the pressurized fluid between the fluid passageway means and the other of the two cylinder chambers, said one of the two cylinder chambers being adapted to contain another fluid; and third valve means, provided by movement in the direction of the longitudinal axis of one of the overcap throat aperture relative to the inner surface of the cylinder neck, when the overcap throat is disposed in the cylinder neck, for controllably affecting fluid flow between the one cylinder chamber and the fluid-mixing region, fluid pressure in said other one of the two cylinder chambers acting upon the piston and thereby urging said other fluid out of said one of the two cylinder chambers, for combining said other fluid with the pressurized fluid at the fluid-mixing region.

3. The piston-powered dispensing system in accordance with claim 2 wherein the overcap and the cylinder together define engageable leveraging means for causing one of the overcap and cylinder to be displaced along the longitudinal axis relative to the other when said one of the overcap and cylinder is rotated thereabout relative to said other.

4. The piston-powered dispensing system in accordance with claim 3 wherein the overcap defines a cup-shaped receptacle, wherein the cup-shaped receptacle portion of the overcap is substantially circular in transverse cross section and is so dimensioned as to overlie an end portion of the cylinder, and wherein the leveraging means comprises:

the cup-shaped receptacle portion of the overcap; and cam-action means defined by respective engaging portions of the receptacle and the exterior surface of the cylinder.

5. The piston-powered dispensing system in accordance with claim 3 wherein the overcap defines a cup-shaped receptacle, wherein the cup-shaped receptacle portion of the overcap is substantially circular in transverse cross section and is so dimensioned as to overlie an end portion of the cylinder, and wherein the leveraging means comprises:

the cup-shaped receptacle portion of the overcap; and mated, intermeshing screw threads defined by mated, respective engaging portions of the receptacle and the exterior surface of the cylinder.

6. The piston-powered dispensing system in accordance with claim 3 wherein the overcap further defines a collar, wherein the overcap collar is so configured as to surround the overcap throat and be concentric therewith, wherein the overcap collar is so spaced from the overcap throat as to engage the cylinder neck when the cylinder neck is disposed between the overcap collar and throat, and wherein the leveraging means comprises:

the collar portion of the overcap; and mated, intermeshing screw threads defined by mated, respective engaging portions of the overcap collar and the exterior surface of the cylinder neck.

7. The piston-powered fluid-dispensing system in accordance with claim 2, wherein the pressurized fluid is a diluting fluid, wherein said other fluid is a dilutable fluid, and wherein the fluid-dispensing system further comprises an orificed nozzle carried by the overcap, the nozzle defining at least one orifice so disposed and dimensioned as to enable the dilutable fluid to pass from the one cylinder chamber to the fluid-mixing region via the first valve means, the nozzle further defining a plurality of additional orifices so spaced about the dilutable-fluid orifice and so angled relative to each other and to the disposition of the dilutable-fluid orifice as to cause the diluting fluid passing through said additional orifices to converge at the fluid-mixing region and there to combine with the dilutable fluid.

* * * * *